United States Patent [19]

d'Andréa et al.

[11] 4,100,881

[45] Jul. 18, 1978

[54] APPARATUS FOR APPLYING A COVERING ON HEAT-SENSITIVE ARTICLES BY MEANS OF A BLOWPIPE

[75] Inventors: Félix d'Andréa, Asnieres; Louis Minjolle, Tarbes, both of France

[73] Assignee: Commissariat a l'Energie Atomique, Paris, France

[21] Appl. No.: 229,224

[22] Filed: Feb. 24, 1972

[30] Foreign Application Priority Data

Feb. 24, 1972 [FR] France ..... 71.06249

[51] Int. Cl.[2] ..... B05B 13/02; B05C 5/00

[52] U.S. Cl. ..... 118/319; 118/314; 118/318; 118/320; 118/DIG. 11; 427/233; 427/398 D; 427/422; 427/425; 427/427

[58] Field of Search ..... 118/300, 317, 318, 314, 118/305, 320, 322, DIG. 11, DIG. 15, DIG. 13, 319

[56] References Cited

U.S. PATENT DOCUMENTS 2,088,542 7/1937 Westin ..... 118/320 X

*Primary Examiner*—Richard D. Lovering

*Attorney, Agent, or Firm*—Cameron, Kerkam, Sutton, Stowell & Stowell

[57] ABSTRACT

The invention relates to a process and apparatus for applying a covering on heat-sensitive articles by means of a blowpipe. The covering is applied by a sequence of very short spraying or blasting steps separated from one another by comparatively long cooling stages. The article is carried by a continuous moving support member in the form of a circular wheel, the articles being rotatably mounted in lateral rims on the wheel.

4 Claims, 3 Drawing Figures

APPARATUS FOR APPLYING A COVERING ON HEAT-SENSITIVE ARTICLES BY MEANS OF A BLOWPIPE

This invention relates to the provision of a covering on articles by spraying or blasting by blowpipes and to a process and apparatus for preparing such coverings, more particularly on heat-sensitive articles without damaging the same.

In the process according to the invention, the covering is prepared in each zone of the article by a sequence of very short spraying or blasting steps separated from one another by comparatively very long cooling stages, so that the mean temperature of the article remains low and substantially constant in the covering zone and the minimum-to-maximum temperature spread is low in such zone in each blasting step.

The invention also relates to an apparatus for carrying the process just described into practice, wherein the apparatus comprises at least one stationary blowpipe for spraying or blasting and a continuous moving support member bearing the article for treatment and having drive means and adapted to present the article to the blowpipe at intervals, the exposure time of the same zone of the article to spraying or blasting being very short relatively to the time between two consecutive exposures.

The invention will now be described by way of example with reference to the accompanying drawings in which.

In the process according to the invention, an article on which it is required to produce a covering is given a sequence of very short blasting or spraying steps or stages which are separated from one another by comparatively very long cooling stages. There is, therefore, very little accumulation of heat in the article during the spraying or blasting treatment and virtually all the accumulated heat can be dissipated during the lengthy cooling stage between consecutive blasting or spraying stages; the mean temperature of the article remains low and virtually constant in the covering or coating operation, and so articles which are very sensitive to thermal shock can be treated without any risk of damage.

Figure 1:
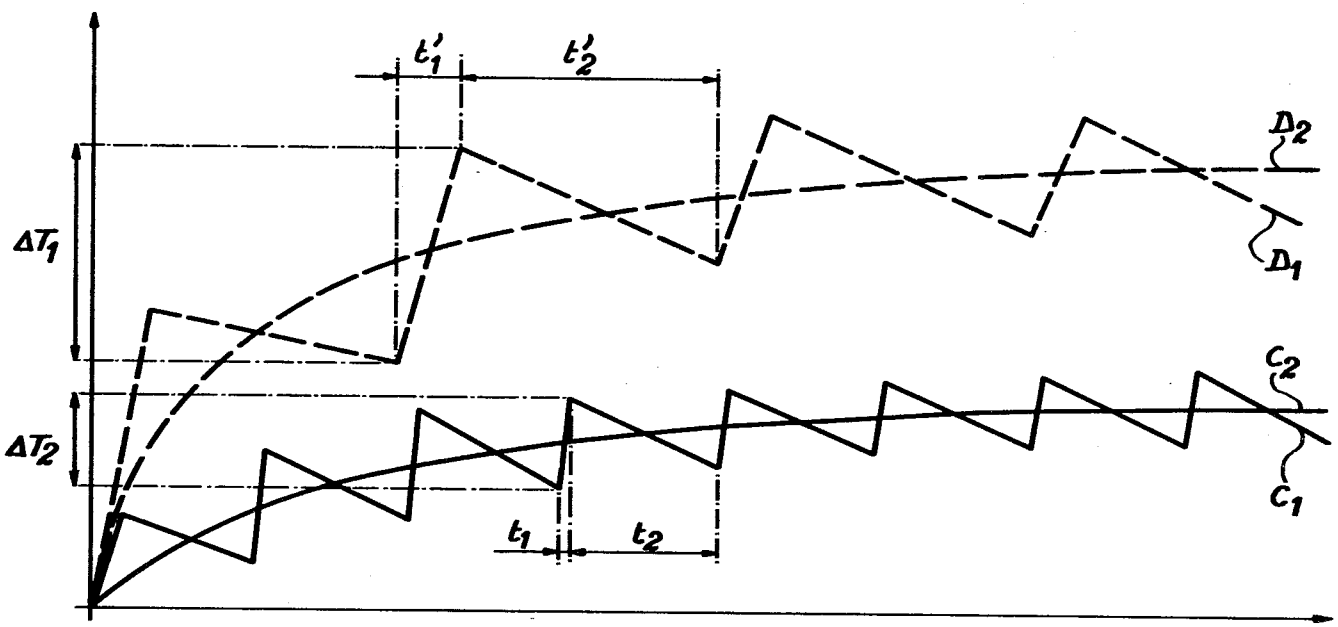
FIG. 1 is a diagram schematising the process according to the invention.

This idea is shown in FIG. 1, where solid-line curves represent a covering or coating operation performed by the process according to the invention and broken-line curves represent a similar operation but with much longer blasting and cooling times. The curves are purely schematic and their only aim is to explain the process according to the invention. More particularly, for convenience of illustration the ratios between blasting and cooling times are longer than they would be in practice.

The bottom solid-line sawtooth curve $C_1$ represents actual temperature variation in that zone of an article which is being treated, plotted against the time taken for the covering operation, and the smooth solid-line curve $C_2$ represents the mean temperature variation in the same zone of the article, plotted against time. Clearly, the spraying or blasting time $t_1$ is very short — much shorter than the cooling time $t_2$ — and the spread or differential $\Delta T$ between the temperature of the article at the beginning of any spraying stage and its temperature at the end of such stage is very reduced, actually being a few degrees centigrade.

The spraying time $t_1$ varies with the nature of the covering and of the article; preferably, it is always of the order of a fraction of a second, advantageously, of the order of 0.01 second. The ratio of $t_1$ to $t_2$ also depends upon the nature of the covering and the nature of the article but should always be very low, preferably between approximately 1 : 100 and 1 : 120.

After the initial phase of the process, curve $C_2$ remains substantially constant and very low, temperature depending mainly upon the heat conductivity of the material of which the article for treatment is made. The times $t_1$, $t_2$ should therefore be adjusted in dependence upon such material to give curves having the same pattern as curves $C_1$ and $C_2$, to obviate destruction of the article in cases in which the same is particularly sensitive to thermal shock.

The top curves $D_1$, $D_2$ correspond to the curves $C_1$, $C_2$ but are the result of much higher $t'_1 : t'_2$ ratios and longer blasting times $t'_1$. Clearly, the longer blasting times greatly increase the temperature differential $\Delta T_1$, while the shorter cooling times raise the mean temperature of the article. This procedure is therefore unsuitable for heat-sensitive articles.

According to another feature of the invention, blasting is so performed that the blast-receiving zone of the article is not the same in each stage, so that the periphery of the article can be covered completely uniformly and the consecutive blasting or spraying stages can be closer together in time; if two consecutive blastings of the same zone are required, the conditions set forth for blasting time and blasting time to cooling time ratio must be observed.

The heat conductivity of the material of which the object is made must be borne in mind to prevent overheating. Thick coverings can be produced without internal stressing developing if consecutive thin coverings are given.

The process according to the invention is of use for all kinds of covering, e.g., refractory oxides on metals and metals on a variety of articles or substrates. The process is particularly useful for articles in shape resembling a tube or body of revolution, since automation of the process can be provided readily, with great advantages industrially.

Any kind of blast pipe or blowpipe suitable for spray coating or the like is of use for the purposes of the invention.

Figure 2:
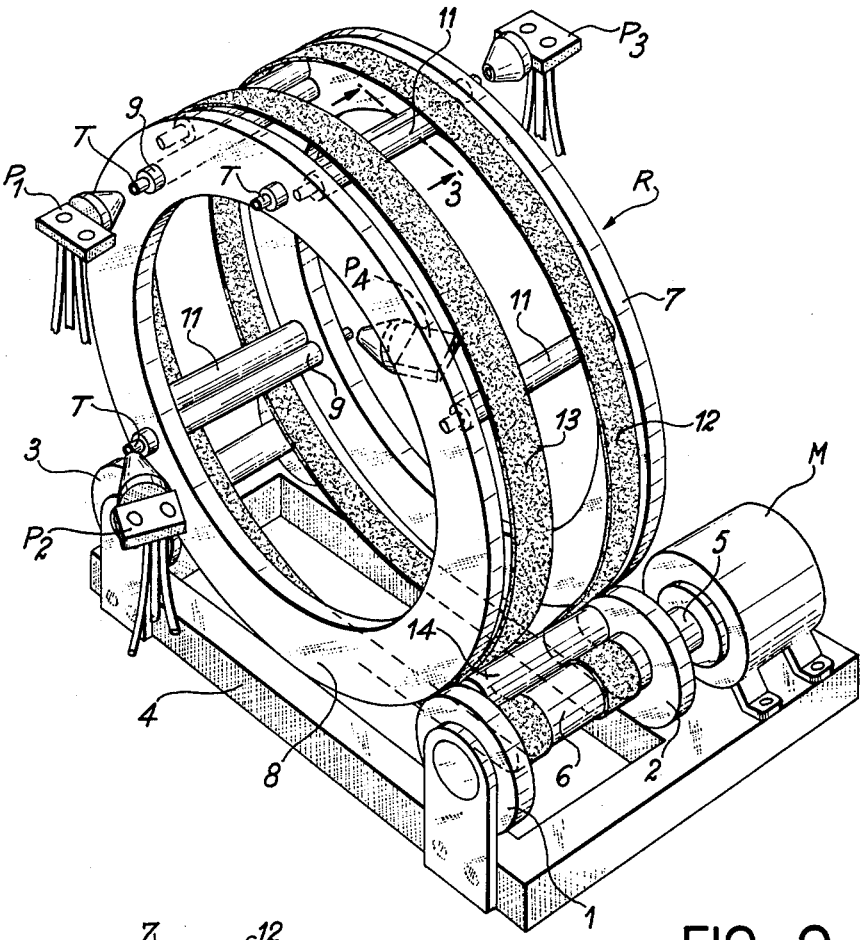
FIG. 2 is a perspective view of an apparatus for carrying the invention into practice.
Figure 3:
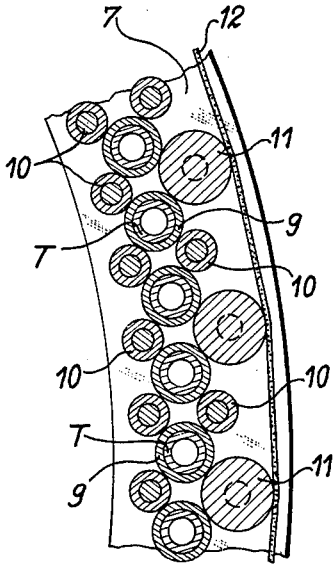
FIG. 3 is a section on the line 3—3 of FIG. 2.

FIGS. 2 and 3 show an embodiment of an apparatus according to the invention, of use for covering or coating articles which in shape are bodies of revolution, such as tubes. The apparatus comprises a continuous moving support member in the form of a circular wheel R disposed on four rollers of which three 1, 2, 3 are visible in FIG. 2. The rollers are mounted on a plinth or base 4. The rollers 1, 2, which are disposed parallel to one another on the same side of the wheel R, are rotated by a motor M via a shaft 5. A cylindrical sleeve 6 rigidly interconnects the rollers 1, 2.

The wheel R comprises two parallel annular rims or cheeks or the like 7, 8 interconnected by a number of article support members or article mounts which in this embodiment take the form of tubular sheaths 9; for the sake of clarity, only some of the sheaths are shown in FIG. 2. The sheaths 9 are received in passages in the rims and can rotate freely therein. A tube T whose ends it is required to cover, e.g., with a refractory oxide, by pipe blasting or spraying is intimately engaged in each sheath 9, with or without the interposition of an anti-friction film to assist penetration into the sheath. The tubes T move solidly with the sheaths 9 in all the movements thereof.

Clearly, the sheaths 9 and tubes T are moved by the wheel R past blowpipes $P_1$, $P_2$, $P_3$, $P_4$ which can be of any type suitable for covering or coating or the like. Pipes $P_1$, $P_3$ are operative axially of the tubes T and pipes $P_2$, $P_4$ act laterally on each tube end.

The sheaths 9 are also rotated around themselves in the rims 7, 8 by means shown in greater detail in FIG. 3. The sheaths 9 are retained laterally in the rims 7, 8 by idler rollers 10 and are rotated by rollers 11 running in the rims 7, 8, each roller 11 engaging with two sheaths 9 in the manner visible in FIG. 2. Consequently, as they rotate the rollers 11 rotate the sheaths 9 — and the tubes T rigidly secured thereto around themselves. The rollers 11 are in turn rotated by two belts 12, 13 which engage with each roller 11 which also run around the sleeve 6 interconnecting the rollers 1 and 2. A guiding and tensioning idler roller 14 mounted in two support members (not shown) tensions the belts 12, 13 on the rollers 11 and sleeve 6. The articles for treatment — tubes in the case shown — can therefore perform a planetary motion and so never offer the same generatrix to the same blast pipe, thus improving the uniformity of the covering or coating.

The apparatus is controlled from a control console providing starting of the pipes and rotation of the wheel. The pipes and the wheel are stopped automatically and simultaneously by a facility which is not shown.

Operation is very simple. After rods of the material to be sprayed or blasted have been placed in the blowpipes and after the tubes have been placed in the sheaths 9 (an operation which can readily be automated), the pipes are ignited and the wheel rotated before them until the required covering has been produced, whereafter the pipes and the wheel stop. In practice, the articles are placed very close together on the wheel periphery, in the manner visible in FIG. 3, and the pipes operate continuously; the time between the passages of consecutive articles past any pipe is very short and so wastage of coating material is very reduced.

Of course, each zone of the tube is presented to any pipe only once per revolution, the remainder of the revolution being for cooling. Advantageously, matters are so devised, and the wheel is so driven, that each zone of the tube remains for only a fraction of a second before each pipe and the cooling time is e.g. from 100 to 120 times longer than the blasting or spraying time.

As an exemplary feature of the invention, the wheel R can have 120 tubes and rotate, as shown, past four blowpipes. The wheel is used to coat ceramic tubes — i.e. tubes which are sensitive to thermal shock — with alumina. The wheel rotates at a constant speed of 1 revolution per second and the tubes T are rotated on themselves by the belts 12, 13 at a speed of three $\frac{1}{3}$ revolutions per second. In each revolution the tubes spend 1/120 sec. before the pipes and are cooled for 119/120 sec. The total treatment time for the 120 tubes is 20 minutes.

An apparatus of this kind can therefore give automatic treatment of a large number of articles in a very short time and with great uniformity. Results are completely reproducible, so that the apparatus is very useful for treating long runs of identical articles.

If required, means such as a fan or blower can be provided to supply secondary air around the articles, thus further accelerating their cooling between spraying or blasting stages.

The invention is not, of course, limited to the purely exemplary embodiments described and shown. For instance, without departing from the scope of this invention, any continuous support means for bringing the articles for treatment before the or each spray or blast pipe cyclically can be used instead of the wheel R. For flat articles, e.g. plates or the like, it is advantageous to use instead of the wheel an endless conveyor belt to which the plates are secured and which moves past pipes positioned appropriately to provide the required covering or coating.

We claim:

1. An apparatus for producing a covering comprising at least one stationary blowpipe for spraying or blasting, a continuous moving support member bearing the article for treatment, drive means for said support adapted to present the article to the blowpipe at intervals, the exposure time of the same zone of the article to spraying or blasting being very short relative to the time between two consecutive exposures, said support being a wheel, two lateral rims for said wheel, article support members rotatably mounted between said rims and means for engaging the articles on said support members as to move solidly therewith in all movements of said support members.

2. An apparatus according to claim 1 wherein the wheel-driving means comprise a motor driving two rollers on which the rim edges bear.

3. An apparatus according to claim 1 including means for rotating the article support members in the wheel rims including rollers in contact with said members and rotating in the rims, and at least one endless belt engaged with said rollers and driven by the motor driving the wheel rollers.

4. An apparatus according to claim 1 wherein the articles are tubes and the article support members are tubular sheaths therearound.

* * * * *